US008533871B2

(12) United States Patent
Fiegener et al.

(10) Patent No.: US 8,533,871 B2
(45) Date of Patent: Sep. 17, 2013

(54) LACROSSE SHIRT AND PROTECTIVE PAD ASSEMBLY

(75) Inventors: John D. Fiegener, Marbelhead, MA (US); Daniel R. Armstrong, Fort Thomas, KY (US); Michael Tintsman, Malden, MA (US)

(73) Assignee: adidas AG, Herzogenaurach (DE)

( * ) Notice: Subject to any disclaimer, the term of this patent is extended or adjusted under 35 U.S.C. 154(b) by 160 days.

(21) Appl. No.: 12/480,144

(22) Filed: Jun. 8, 2009

(65) Prior Publication Data

US 2010/0306907 A1 Dec. 9, 2010

(51) Int. Cl.
*A41D 1/04* (2006.01)

(52) U.S. Cl.
USPC ..... 2/456; 2/461; 2/113

(58) Field of Classification Search
USPC ..... 2/115, 462, 268, 108, 267, 456–458, 2/102, 463, 2.5, 112, 309, 311, 464, 455, 2/459, 461; 24/265 AL
See application file for complete search history.

(56) References Cited

U.S. PATENT DOCUMENTS

| | | | | |
|---|---|---|---|---|
| 1,970,130 | A * | 8/1934 | Dickenson | 2/462 |
| 3,991,420 | A * | 11/1976 | Savarino | 2/462 |
| 4,397,636 | A | 8/1983 | Ganshaw | |
| 4,453,271 | A * | 6/1984 | Donzis | 2/456 |
| 4,479,269 | A | 10/1984 | Balliet | |
| 4,507,801 | A * | 4/1985 | Kavanagh et al. | 2/462 |
| 4,561,124 | A | 12/1985 | Thompson | |
| 4,700,407 | A | 10/1987 | Mattila | |
| 4,870,706 | A | 10/1989 | Ketchum et al. | |
| 5,105,473 | A | 4/1992 | Valtakari | |
| 5,129,101 | A | 7/1992 | Douglas | |
| 5,173,964 | A * | 12/1992 | Ball et al. | 2/461 |
| 5,226,192 | A | 7/1993 | Jones et al. | |
| 5,390,368 | A * | 2/1995 | Chang | 2/462 |
| 5,918,310 | A | 7/1999 | Farahany | |
| 5,966,739 | A | 10/1999 | Wagner | |
| 6,070,273 | A | 6/2000 | Sgro | |
| 6,260,196 | B1 | 7/2001 | Van der Sleesen | |
| 6,289,524 | B1 | 9/2001 | Wright et al. | |
| 6,295,654 | B1 * | 10/2001 | Farrell | 2/456 |
| 6,748,601 | B2 | 6/2004 | LaShoto et al. | |
| 6,782,559 | B2 | 8/2004 | Regan | |
| 6,804,832 | B2 | 10/2004 | Beland | |
| 6,810,534 | B2 * | 11/2004 | Durkin et al. | 2/267 |
| 6,842,915 | B2 | 1/2005 | Turner et al. | |
| 6,966,070 | B2 * | 11/2005 | Gillen et al. | 2/102 |
| 7,076,806 | B1 * | 7/2006 | Van Winkle et al. | 2/2.5 |

(Continued)

FOREIGN PATENT DOCUMENTS

| | | |
|---|---|---|
| GB | 2199233 | 7/1988 |
| GB | 2238708 | 12/1991 |

OTHER PUBLICATIONS http://www.brine.com/menslax/products/protective/rhinoskin (3 pages).

*Primary Examiner* — Richale Quinn
(74) *Attorney, Agent, or Firm* — Sterne, Kessler, Goldstein & Fox P.L.L.C.

(57) ABSTRACT

A garment comprising an undershirt having a plurality of first pads, at least two mounting loops extending from the undershirt, a plurality of second pads, each of the plurality of second pads having at least two fingers, and wherein the at least two fingers are engaged with the at least two mounting loops to secure the plurality of second pads to the undershirt.

22 Claims, 8 Drawing Sheets

(56) References Cited

U.S. PATENT DOCUMENTS

| | | | | |
|---|---|---|---|---|
| 7,100,216 | B2 | 9/2006 | Matechen et al. | |
| 2002/0007509 | A1 | 1/2002 | Kamada | |
| 2003/0079271 | A1* | 5/2003 | Gillen et al. | 2/102 |
| 2003/0079277 | A1* | 5/2003 | Gillen et al. | 2/268 |
| 2003/0167560 | A1* | 9/2003 | LaShoto et al. | 2/463 |
| 2004/0199983 | A1* | 10/2004 | Gillen et al. | 2/456 |
| 2005/0066428 | A1 | 3/2005 | Bellfy | |
| 2005/0081277 | A1* | 4/2005 | Matechen et al. | 2/102 |
| 2006/0048292 | A1* | 3/2006 | Gillen et al. | 2/456 |
| 2006/0053526 | A1 | 3/2006 | Beland et al. | |
| 2006/0053535 | A1 | 3/2006 | Ide et al. | |
| 2006/0059609 | A1 | 3/2006 | Moss | |
| 2006/0179545 | A1 | 8/2006 | Arensdorf et al. | |
| 2006/0248625 | A1 | 11/2006 | Van Trojen | |
| 2007/0050884 | A1 | 3/2007 | Contant et al. | |
| 2007/0050886 | A1* | 3/2007 | Brassill | 2/115 |
| 2007/0151004 | A1 | 7/2007 | Brassill | |
| 2008/0022431 | A1 | 1/2008 | Gallo et al. | |
| 2008/0040841 | A1 | 2/2008 | Morrow et al. | |
| 2008/0092281 | A1 | 4/2008 | Morrow et al. | |
| 2008/0201828 | A1 | 8/2008 | Kanavage | |

* cited by examiner

LACROSSE SHIRT AND PROTECTIVE PAD ASSEMBLY

BACKGROUND OF THE INVENTION

1. Technical Field

The invention relates generally to athletic pads used to prevent injury during lacrosse or other contact sports. More particularly, the invention relates to an athletic pad assembly that allows removal of an outer pad. Specifically, the invention relates to a separate shoulder pad and sternum protector assemblies which are connected to an undershirt that may have a plurality of additional pads.

2. Background Information

Athletic pads are well known and used in a variety of sports including lacrosse and football. Shoulder pads typically used in football and lacrosse have a neck opening located between two hard shoulder portions which connect at both the front and back below the player's neck. The shoulder pad may be a two piece unit split along the centerline of both the front and back. The back is connected with riveted plates, while the front may be connected with a draw string or plates. The shoulder pad assembly is a ridged unit which redistricts movement of the player. While the player is protected from potential injury, mobility is limited and it is cumbersome to clean and maintain the pads due to their size.

An alternative to the hard style pads are soft pads. Soft pads may be placed within an athletic garment or on the outside of the athletic garment. To locate the pads within the garment, the pad is stitched within a pocket in the garment and is permanently fixed. In an alternative arrangement, soft pads are stitched to the outside of the garment instead of located within a pocket. The soft pads provide much greater mobility for the player since he is not restrained by a ridged one-piece should pad. Nevertheless, the soft pads suffer from a lack of protection. The soft pads cannot withstand the force of harder hits and the player may be injured more readily when wearing soft pads instead of ridged shoulder pads.

One attempt to overcome the problems of the hard shoulder pads and the soft shoulder pads is the Rhinoskin by Brine. The Rhinoskin shoulder pads have a soft pad system covering the entire rib section of a player and extending upwards around the neck to cover the player's shoulders. Further, the soft pads continue down the shoulder blades of the player about half way down his back. On the front side, a loop is stitched near the collar bone area of each side and includes hook or loop on the outside. Similarly, on the back side, a loop is stitched near the shoulder blade of each side and includes hook or loop on the outside. A hard pad, can then be located between the front and back loops on either or both sides. The hard pad includes a length of material with either hook or loop that passes through one of the loops and is wrapped around the loop and secured to the top of the loop.

While the Rhinoskin prior art is adequate for the purpose for which it was intended, there remains needs that must be satisfied in the art.

SUMMARY OF THE INVENTION

The present invention broadly comprises a garment including an undershirt having a plurality of first pads, at least two mounting loops extending from the undershirt, a plurality of second pads, each of the plurality of second pads having at least two fingers, and wherein the at least two fingers are engaged with the at least two mounting loops to secure the plurality of second pads to the undershirt.

BRIEF DESCRIPTION OF THE DRAWINGS

The preferred embodiment of the invention, illustrative of the best mode in which Applicant has contemplated applying the principles of the invention, is set forth in the following description and are shown in the drawings.

DESCRIPTION OF THE PREFERRED EMBODIMENTS

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

The garment of the present invention is indicated generally at 10, as is shown in FIGS. 1 through 9. As particularly shown in FIG. 1, a preferred embodiment garment 10 includes an undershirt 12, a plurality of first pads 14A-14W, and a plurality of second pads 16A-16E. Garment 10 may also include elbow pads 18A and 18B secured to either undershirt 12 or one of the second pads (described below). First pads 14A-14W are soft pads disposed within undershirt 12 in a preferred embodiment, while second pads 16A-16E are hard pads. Although the preferred embodiment illustrates the first pads as soft pads and the second pads as hard pads, one of ordinary skill in the art will immediately realize that the first pads may be hard pads and the second pads may be soft pads, or any combination thereof is within the spirit and scope of the present invention as claimed.

Figure 2:
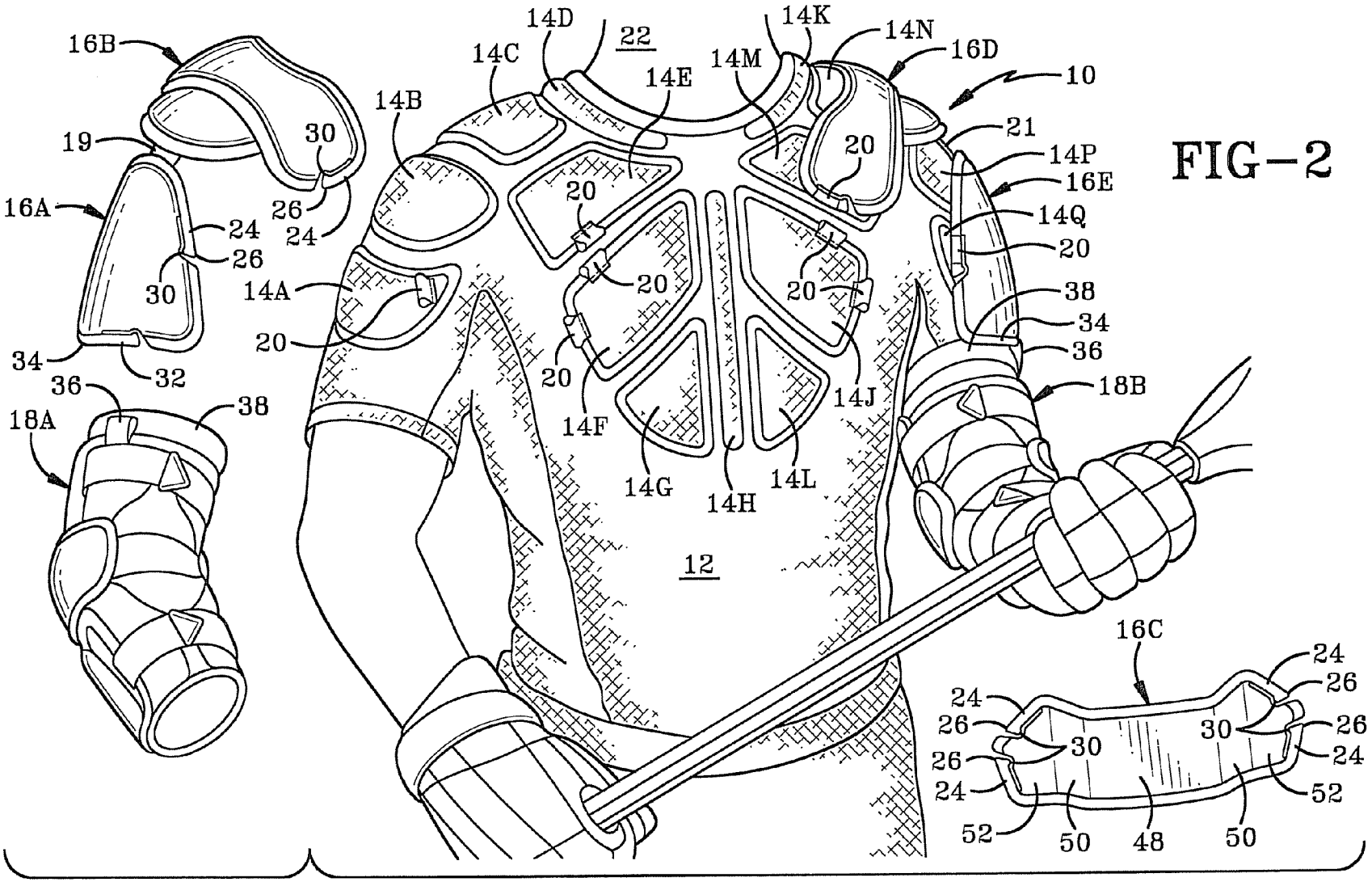
FIG. 2 is a perspective view of a player wearing a preferred embodiment garment with a plurality of second pads located on the player's left side and a plurality of second pads removed from the player's right side and sternum.
Figure 3:
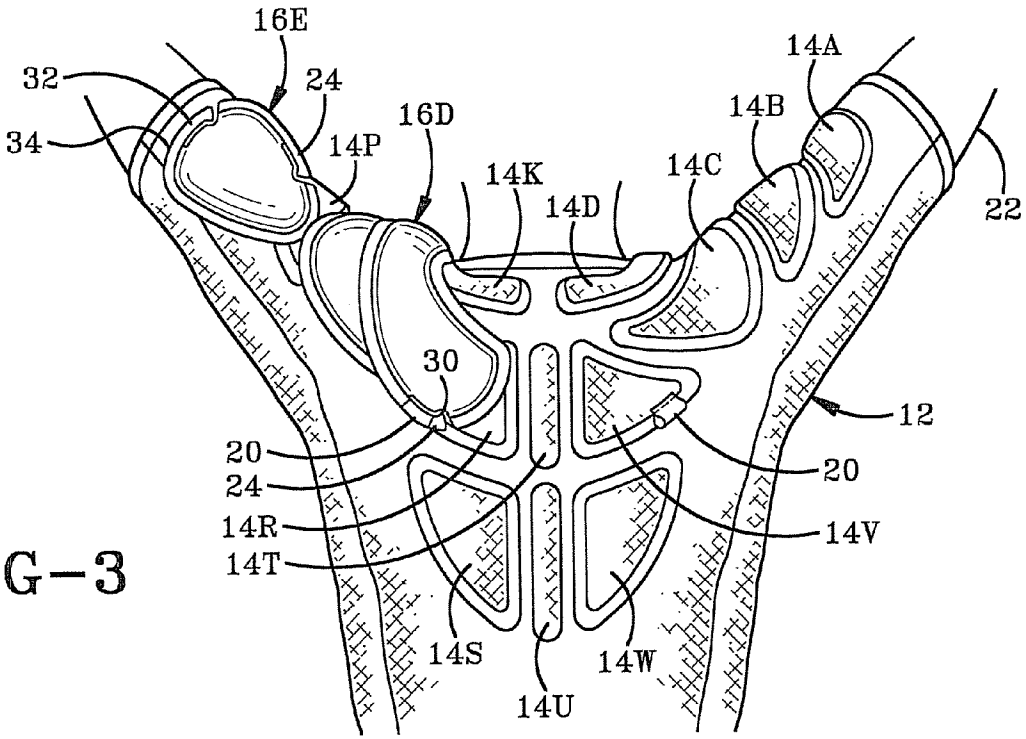
FIG. 3 is a rear view of a player wearing a preferred embodiment garment with a plurality of second pads located on the player's left side and a plurality of second pads removed from the player's right side.

Referring to FIGS. 2 and 3, undershirt 12 is illustrated with second pads 16A, 16B, and 16C removed and second pads 16D and 16E attached. Further, right elbow pad 18A is detached, while left elbow pad 18B is illustrated being worn by a player 22. The right shoulder pad area includes 14A, 14B, 14C, 14D, 14E, and 14V, while the left shoulder pad area includes 14K, 14M, 14N, 14P, 14Q, and 14R. The sternum pad area includes 14F, 14G, 14H, 14L, and 14J.

In accordance with a main feature of the invention, undershirt 12 includes mounting loops 20 at various positions throughout the front and back sides to secure second pads 16A-16E. Mounting loops 20 are preferably a folded piece of straight material sewn to undershirt 12. In a preferred embodiment, each mounting loop 20 is secured to the undershirt within a perimeter of first pads 14. Due to the increased size of second pad 16C, two mounting loops 20 may be secured within the perimeter of a single pad, such as first pad 14F or 14J.

Figure 4:
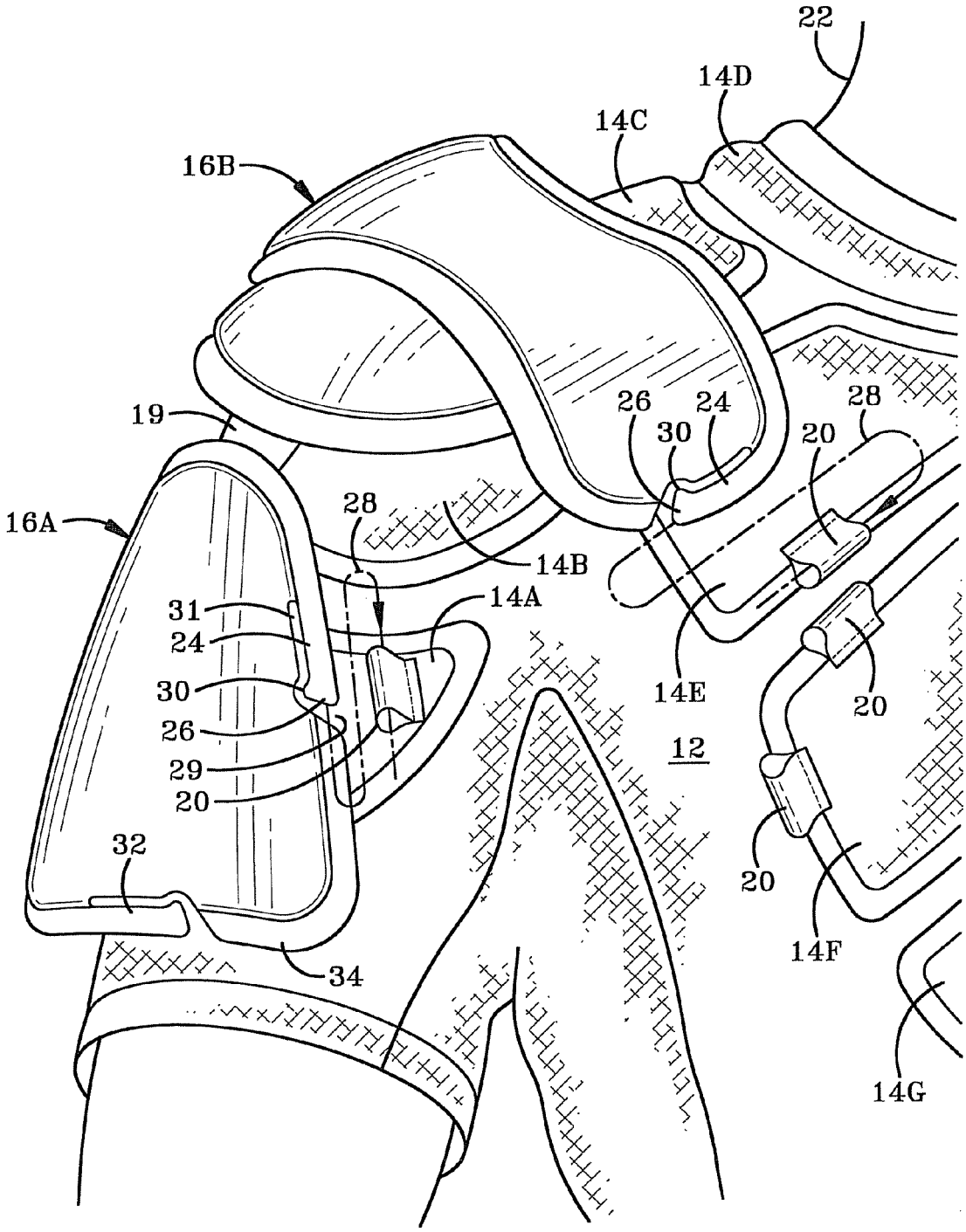
FIG. 4 is an enlarged view of a preferred embodiment second pads being installed within mounting loops as indicated by arrows on a players right side.
Figure 5:
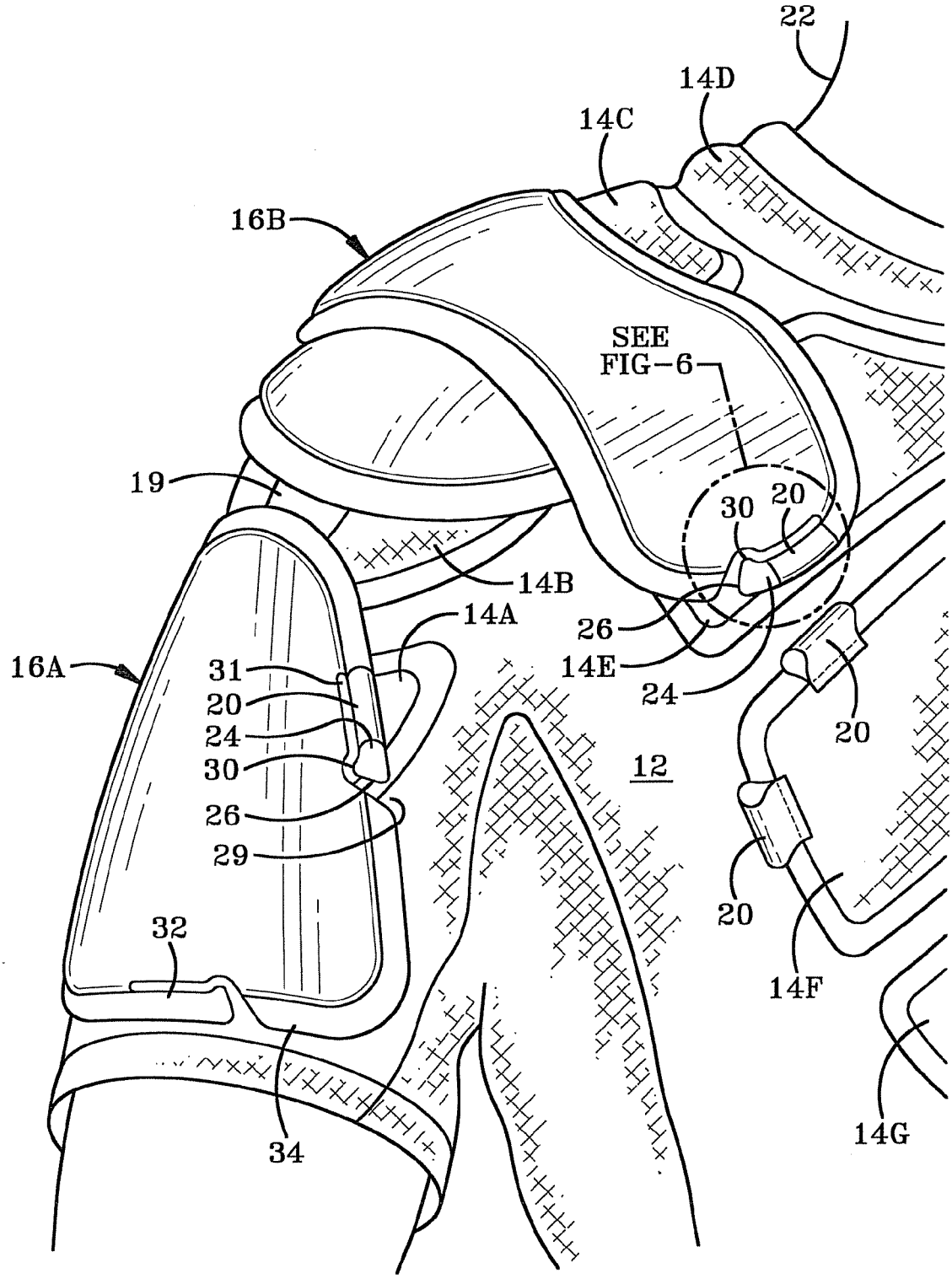
FIG. 5 is an enlarged view of preferred embodiment second pads installed within mounting loops on a player's right side.

Referring to FIGS. 4-5, the second right shoulder pad includes pads 16A and 16B which are secured to undershirt 12 at mounting loops 20 located at first pads 14A, 14E, and 14V. Second shoulder pads 16A and 16B are preferably held together with a connector 19 so that the two second pads function as a single unit. The second left shoulder pad includes pads 16D and 16E, which are secured to undershirt 12 at mounting loops 20 located at first pads 14M, 14Q, and 14R. Similarly, second pads 16D and 16E are held together with a connector 21 so that the two second pads function as a single unit. Finally, the sternum pad includes pad 16C and is secured to undershirt 12 at mounting loops 20 located at first pads 14F and 14J.

Figure 6:
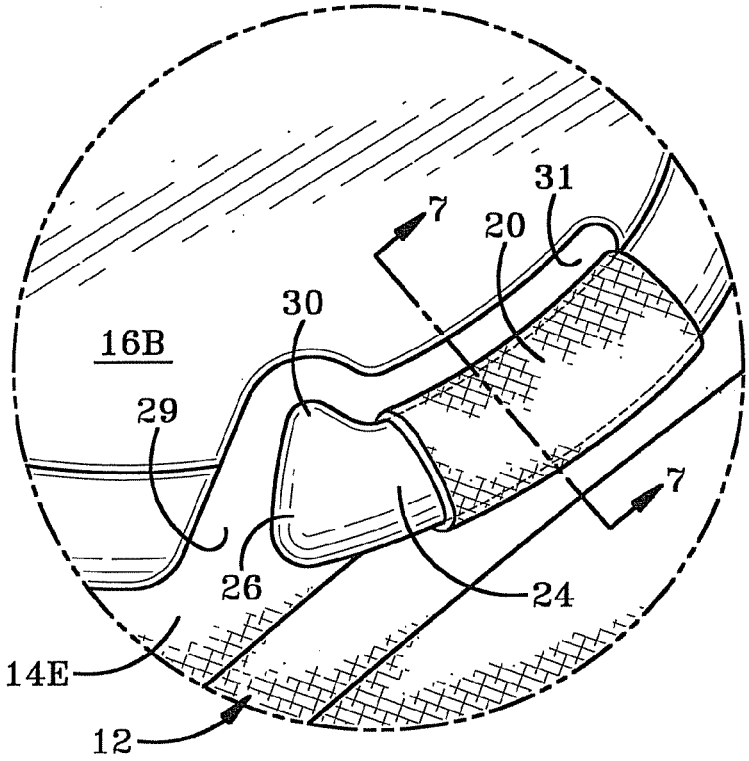
FIG. 6 is an enlarged view of the encircled region of FIG. 5 illustrating a preferred embodiment interaction of the fingers and the mounting loops.
Figure 7:
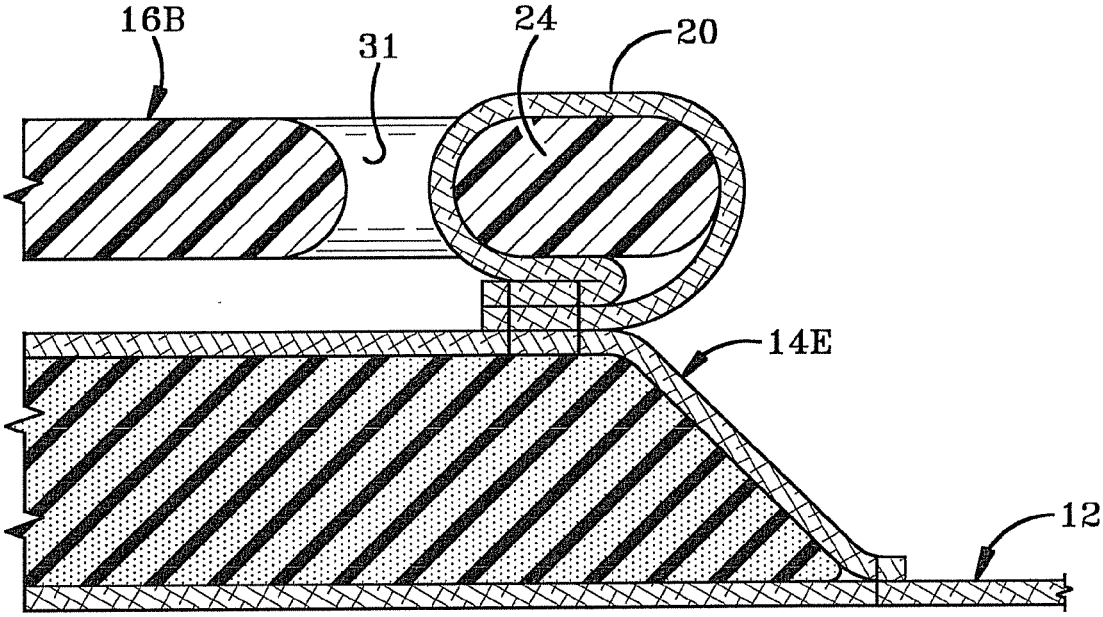
FIG. 7 is a section view of the fingers and mounting loops taken generally along line 7-7 in FIG. 6.

Referring to FIGS. 6-7, in accordance with another main feature of the present invention, second pads 16 include non-parallel fingers 24 formed integral to second pads 16, monolithically therewith. Referring to FIGS. 4 and 5, fingers 24 are formed within a perimeter of second pads 16. Specifically, fingers 24 define at least a portion of the outermost periphery of second pads 16. Second pads 16A and 16B are installed by inserting a distal end 26 of finger 24 within mounting loop 20 in the direction indicated by arrow 28. Since the fingers are secured within mounting loops 20 in different directions, the chances of second pads 16 inadvertently becoming disconnected are reduced.

FIGS. 6 and 7 further illustrate finger 24 engaged with mounting loop 20. A hook 30 extends from distal end 26 inward and helps to prevent finger 24 from becoming inadvertently disconnected from mounting loop 20. At the same time however, fingers 24 can be also be removed from mounting loop 20 to facilitate cleaning of undershirt 12 or second pads 16A-16E. Further, an opening 29 is defined by the second pad and distal end 26 of finger 24. The opening extends proximate hook 30 and finger 24 to define a channel 31. Advantageously, channel 31 allows simple engagement of the finger and mounting loop as well as allowing a wearer to adjust what pads are worn.

Figure 1:
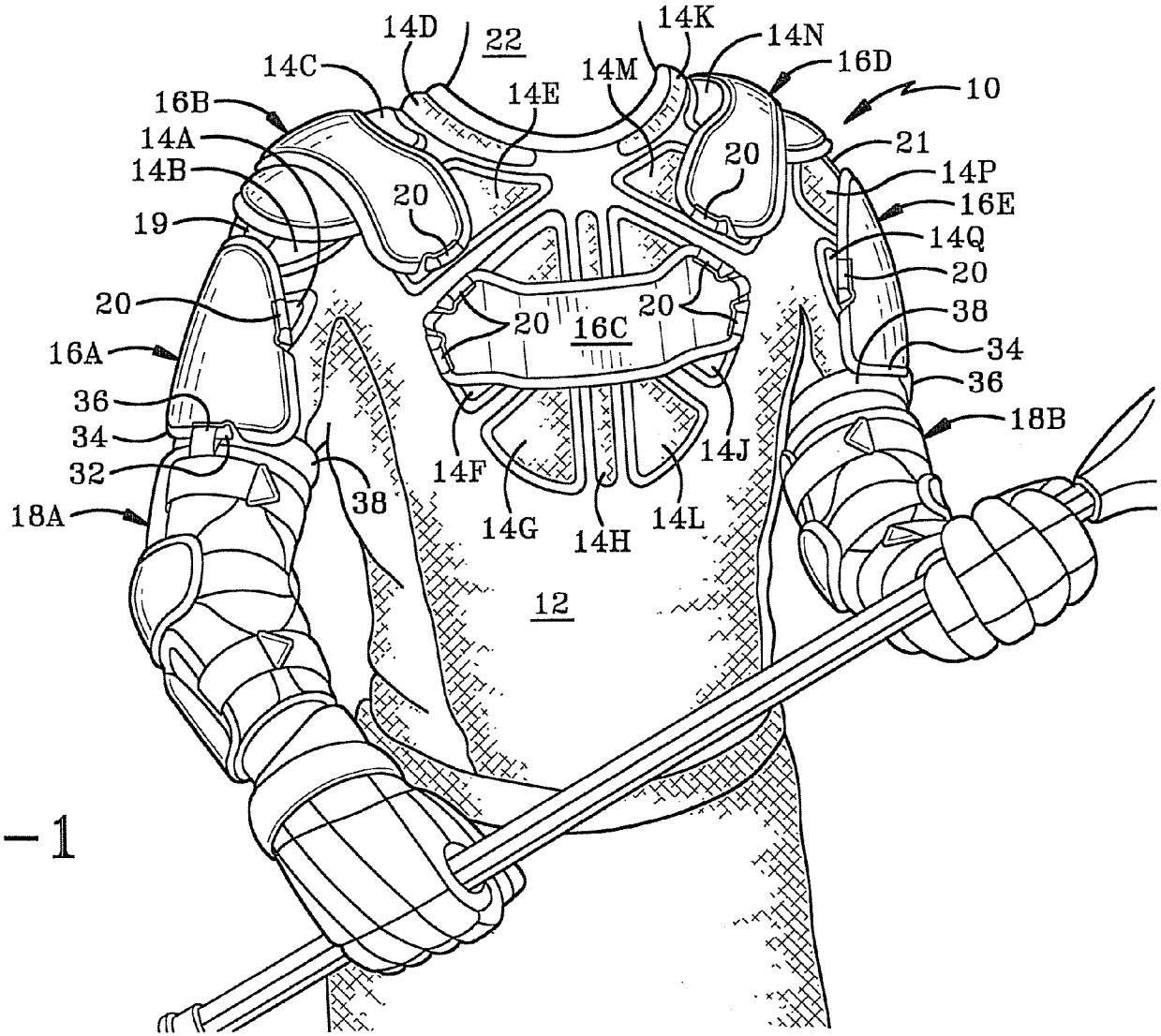
FIG. 1 is a perspective view of a player wearing a preferred embodiment garment with a plurality of first and second pads.

In accordance with yet another main feature of the present invention, second pads 16 include an elbow finger 32 at a terminal end 34 in a preferred embodiment illustrated in FIGS. 1 and 2. Elbow pads 18A and 18B each have an elbow mounting loop 36 at an elbow terminal end 38. Elbow pad 18A and 18B are located on a player's elbow with elbow mounting loop 36 proximate terminal end 34 of second pads 16A. In this position, elbow finger 32 is engaged with elbow mounting loop 36 to insure that the elbow pad is properly positioned during use.

Figure 8:
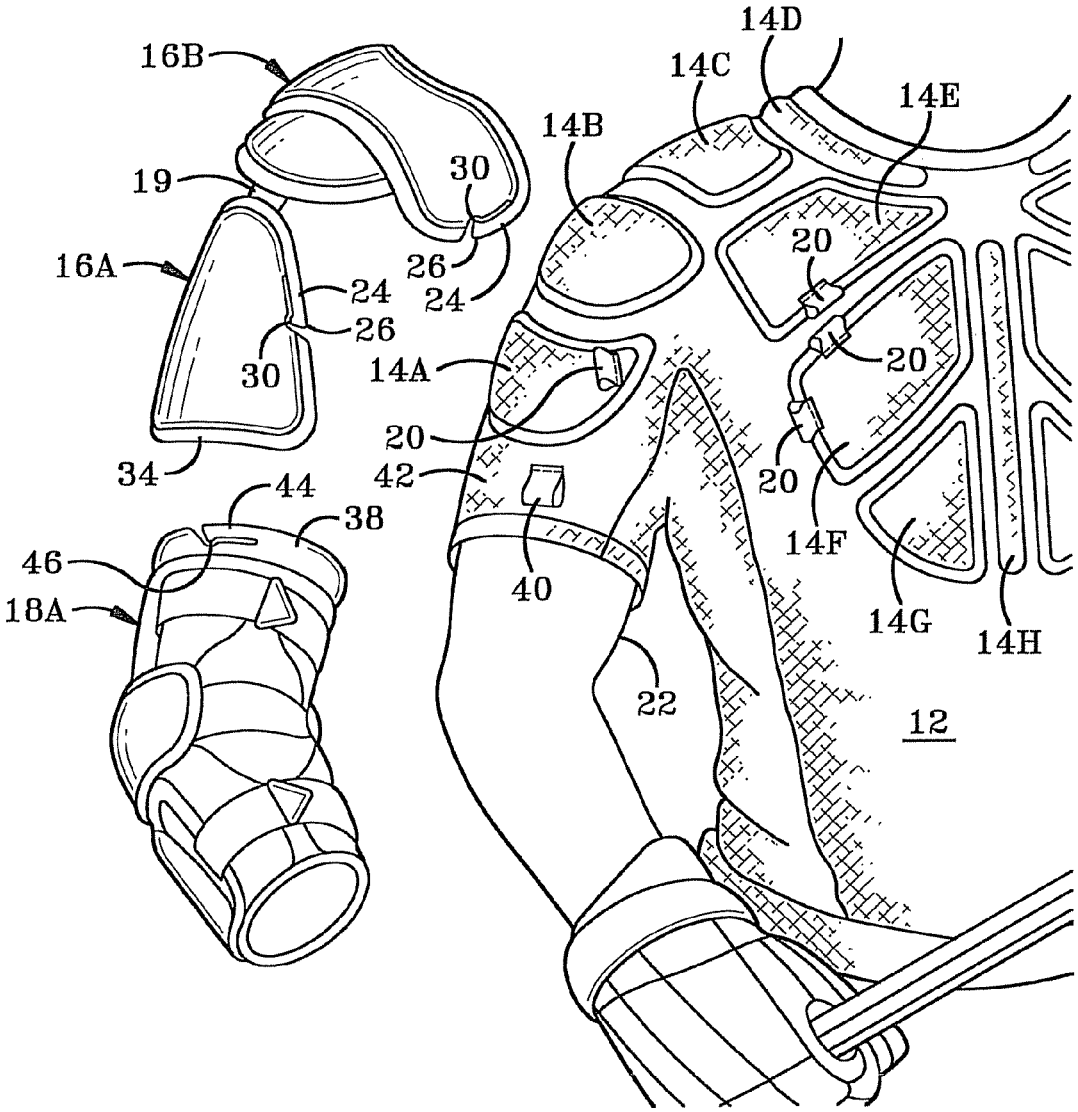
FIG. 8 is a perspective view illustrating a preferred embodiment second pad and elbow pad removed from a player; and, FIG. 9 is a perspective view illustrating another preferred embodiment second pad removed from a player and another preferred embodiment elbow pad secured to the mounting loop.
Figure 9:
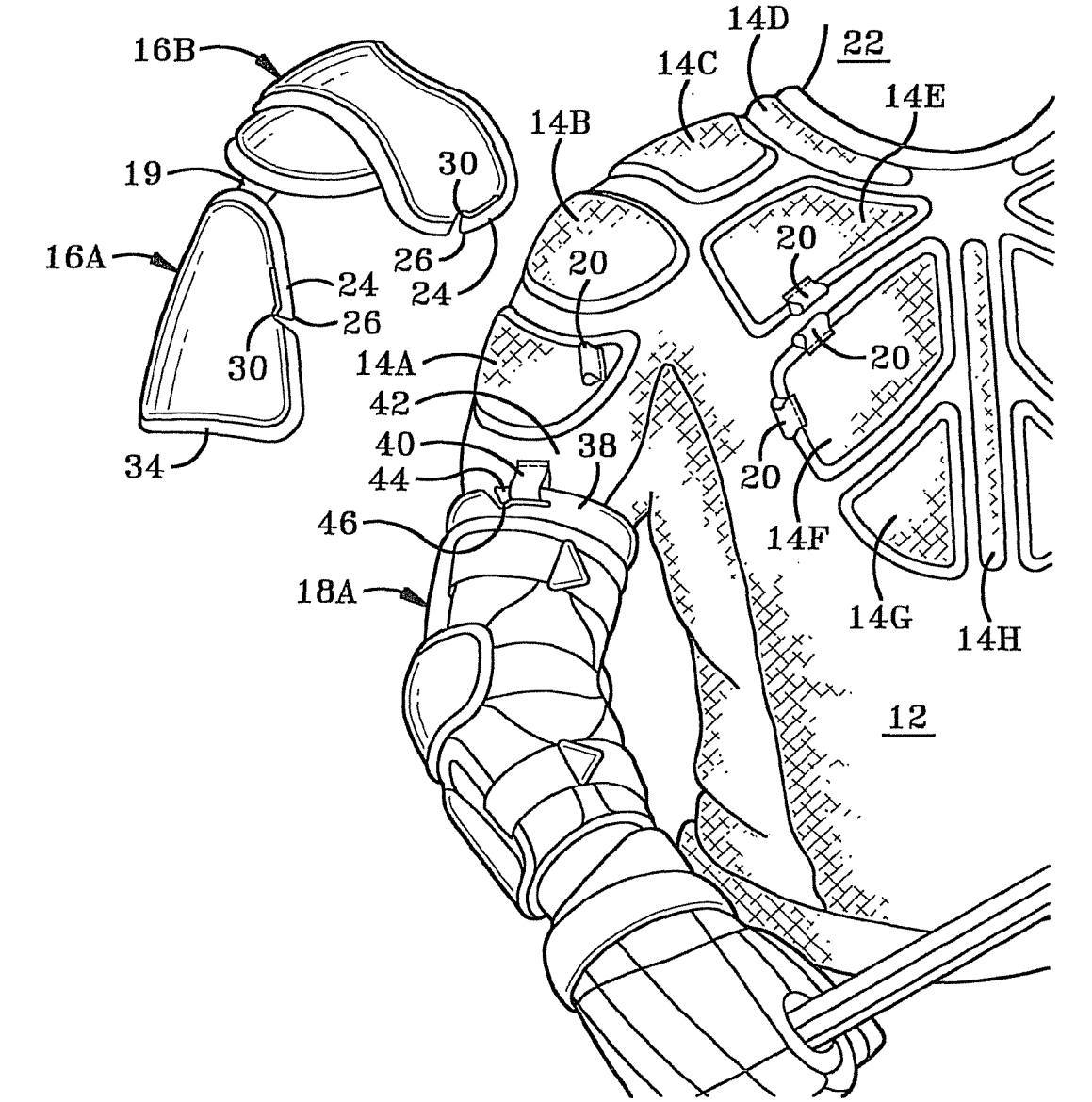

Referring to FIGS. 8 and 9, another preferred embodiment of elbow pads 18A and 18B are illustrated. This embodiment functions similar to the previously described embodiment in that it locates and insures that that the elbow pad is properly positioned during use. The second preferred embodiment will be described with reference to the right side shoulder pad and elbow pad; however the description is equally applicable to the left side. Second pad 16A does not include an elbow finger; instead terminal end 34 is smooth. Undershirt 12 includes a shirt mounting loop 40 sewn to a sleeve 42. Elbow pad 16A includes a finger 44 with a hook 46 both formed in terminal end 38. Finger 44 is formed similar to and functions similar to fingers 24 of second pads 16. Elbow pad 16A is connected to undershirt 12 by engaging finger 44 with shirt mounting loop 40.

In accordance with still another main feature of the present invention, second pad 16C is preferably bow shaped in a direction away from a player's sternum when in use. Referring to FIGS. 1 and 2, second pad 16C includes a center portion 48, an angled portion 50 extending from each side of the center portion and directed backwards, and a mounting flange 52 extending from each of the angled portions. Center portion 48 and mounting flanges 52 are preferably parallel to each other, while angled portion 50 provides the bow-like shape. Second pad 16C, and center portion 48, are each wider than the player's sternum so that contact in the sternum area is deflected through second pad 16C whereby the second pad is deflected inward.

Second pad 16C also includes a plurality of fingers 24 formed in the perimeter of mounting flanges 52. Preferably, two fingers 24 are formed in each mounting flange to insure the second pad is secured in place during play. However, it should be immediately apparent to one of ordinary skill in the art that only one finger 24 is necessary at each mounting flange 52 in order to maintain the second pad proximate the player's sternum. Further, fingers 24 are also preferably arranged with distal ends 26 facing in generally opposite directions and include hooks 30 to prevent accidental removal of second pad 16C.

Second pad 16C connects to undershirt 12 at mounting loops 20 at first pads 14F and 14J. In a preferred embodiment, two mounting loops 20 are located within the perimeter of first pad 14F and first pad 14J. Further, the two loops within each first pad are arranged generally perpendicular to each other to resist inadvertent removal of second pad 16C. In operation, impact at second pad 16C is deflected through the first pads 14F and 14J to reduce the potential for injury to the player.

Having described the structure of a preferred embodiment, a preferred method of operation will be described in detail and should be read in light of FIGS. 1 through 9.

Initially, a wear puts undershirt 12 on and may proceed with only first pads 14A-14W. Next, the wear locates second pads 16A and 16B on one side and second pads 16D and 16E on the other side. In order to locate the second pads, fingers 24 are inserted through corresponding mounting loops 20 on undershirt 12. The same method may be used to locate second pad 16C proximate the wearer's sternum by inserting fingers 24 of second pad 16C within mounting loops 20 on undershirt 12. Next, elbow pads 18A and 18B may be connected by inserting elbow finger 32 within elbow mounting loop 36. While the method of operation has been described as a series of steps, the wearer may decide to wear any number of pads in any combination or wear only the first pads.

During play, second pads 16A-16E absorb impact and transfer the impact force to first pads 14A-14W which are proximate the impact area. The force on the first pads is spread across all of the interconnected pads proximate the impact area and thereby reduces the force. Since the force is reduced because it is spread across a broader area, the first pads also function to absorb the impact.

It will be evident to one skilled in the art that a variety of changes can be made that are within the spirit and scope of the present invention. For instance, the first pads may be a single unit disposed within the undershirt, or may be completely omitted so long as the mounting loops remain to secure the second pads.

Accordingly, the garment is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the garment is constructed and used, the characteristics of the construction, and the advantageous new and useful results obtained; the new and useful structures, devices, elements, arrangement, parts, and combinations are set forth in the appended claims.

What is claimed is:

1. A garment comprising:

an undershirt having a plurality of first pads;

at least two mounting loops extending from the undershirt and disposed within a perimeter of at least one of the plurality of first pads; and a plurality of second pads, each of the plurality of second pads having at least two fingers formed monolithically therewith, wherein each of the at least two fingers defines a channel such that the at least two fingers are slidably engaged with the at least two mounting loops to secure the plurality of second pads to the undershirt.

2. The garment of claim 1, wherein the plurality of second pads are removably secured to the undershirt.

3. The garment of claim 1, wherein each of the at least two fingers comprises a hook proximate a free end thereof.

4. The garment of claim 3, wherein the hook resists disconnection of the finger and the mounting loop.

5. The garment of claim 1, wherein the at least two fingers are contained within the second pad perimeter.

6. The garment of claim 1, wherein the undershirt comprises a mounting loop proximate a terminal end of a sleeve.

7. The garment of claim 6, comprising an elbow pad having at least one finger for engagement with the mounting loop proximate the terminal end of the sleeve.

8. The garment of claim 7, wherein engagement of the mounting loop and the at least one finger is configured to locate the elbow pad on a wearer's elbow.

9. The garment of claim 1, comprising an elbow pad having an end and a mounting loop proximate the end.

10. The garment of claim 9, wherein at least one of the fingers is engaged with the elbow pad mounting loop.

11. The garment of claim 1, wherein each of the at least two fingers are secured within each of the at least two mounting loops in generally opposing directions.

12. The garment of claim 1, wherein the plurality of first pads are soft pads and the plurality of second pads are hard pads.

13. The garment of claim 1, wherein the at least two mounting loops are each disposed within a perimeter of two or more of the plurality of first pads.

14. A garment comprising:

an undershirt having at least one soft pad at each shoulder;

each of the at least one soft pads having at least two mounting loops extending outward from the undershirt and disposed within a perimeter of the at least one soft pad; and at least one hard pad at each shoulder, each of the at least one hard pad having at least two fingers, wherein the at least two fingers are nonparallel to each other, and wherein each of the at least two fingers defines a channel such that the at least two fingers are slidably engaged with the at least two mounting loops.

15. The garment of claim 14, wherein the at least one hard pad at each shoulder comprises at least one mounting loop proximate a terminal end of the at least one hard pad.

16. The garment of claim 15, comprising an elbow pad having at least one finger, wherein the elbow pad at least one finger is engaged with the at least one mounting loop proximate the terminal end of the at least one hard pad.

17. The garment of claim 16, wherein engagement of the at least one mounting loop proximate the terminal end of the at least one hard pad and the at least one finger is configured to locate the elbow pad on a wearer's elbow.

18. A garment comprising:

a shirt having a first pad disposed thereon, the first pad defining a perimeter;

a mounting loop extending from the shirt within the first pad perimeter; and a second pad having a perimeter and a finger at the second pad perimeter defining a channel therein, the channel having an open end and a closed end, wherein the finger is adapted to slidably engage with the mounting loop to secure the second pad to the shirt.

19. The garment of claim 18, wherein the second pad is selected from the group consisting of: a shoulder pad, an elbow pad, and a sternum pad.

20. The garment of claim 18, wherein the channel is configured to engage the mounting loop.

21. The garment of claim 18, wherein the closed end is configured to limit movement of the mounting loop within the channel.

22. The garment of claim 18, wherein the channel extends along the second pad perimeter.

* * * * *